US006394019B1

(12) United States Patent
West

(10) Patent No.: US 6,394,019 B1
(45) Date of Patent: May 28, 2002

(54) ANTI-CAPSIZE WATERCRAFT

(76) Inventor: John F. West, 210 Firestone La., Sanford, NC (US) 27330

( * ) Notice: Subject to any disclaimer, the term of this patent is extended or adjusted under 35 U.S.C. 154(b) by 0 days.

(21) Appl. No.: 09/840,685

(22) Filed: Apr. 23, 2001

(51) Int. Cl.[7] ..... B63C 9/06
(52) U.S. Cl. ..... 114/350; 114/360
(58) Field of Search ..... 114/350, 123, 114/360, 348, 349, 61.11, 61.15, 61.1, 283, 292, 68, 56.1, 61.16; 440/99

(56) References Cited

U.S. PATENT DOCUMENTS 1,711,726 A * 5/1929 Fogas ..... 116/65 R
3,807,333 A * 4/1974 Ross ..... 114/61.1

* cited by examiner

*Primary Examiner*—Ed Swinehart
(74) *Attorney, Agent, or Firm*—Mills Law Firm PLLC

(57) ABSTRACT

An anti-capsizing watercraft for propulsion over rough water includes three flotation members radially and circumferentially spaced connected with a hub member and an occupant platform rotatably connected with said hub member whereby at least two floatation members support the craft during rolling movement in the rough water with the occupant platform maintaining a stable level orientation.

7 Claims, 5 Drawing Sheets

ANTI-CAPSIZE WATERCRAFT

FIELD OF THE INVENTION

The present invention relates to recreational watercraft, and, in particular, a multiple floatation watercraft having anti-capsizing floatation members and a rotatable crew carrier for maintaining safe craft operation under hazardous water conditions.

BACKGROUND OF THE INVENTION

Many recreational water sports, such a kayaking and white water rafting, require navigating a watercraft in treacherous and turbulent waters. These conditions pose many dangers and discomforts to the participants. The craft may pitch and roll violently subjecting the crew to perilous orientations and possibly being thrown overboard. The craft is also subject to capsizing when the rolling conditions exceed the stability conditions for the craft.

Various approaches have been proposed for increasing the safety and comfort of the crew under varying water conditions. U.S. Pat. No. 4,771,722 to Tihany discloses plural outrigger pontoons for stabilizing the main watercraft. While providing increased stability for the craft, the occupant is nonetheless subjected to the turbulent conditions, and under extreme conditions the watercraft may capsize. Another approach is disclosed in U.S. Pat. No. 5,692,450 to Alter et al. wherein the crew seat is fixed supported between laterally spaced pontoons. The user is subjected to all craft movements, and the vessel is subject to capsizing under rough water conditions.

U.S. Pat. No. 5,669,858 to Blair provides a measure of resiliency for the user under rough conditions by providing a trampoline type occupant support. No provisions are made for preventing capsizing.

U.S. Pat. No. 5,441,454 to Race provides the occupants with a laterally pivotally supported seating assembly for rocking movement, primarily for pleasure enhancement during sailing. No provision other than spaced pontoons are provided for rolling stability. Boater comfort is also provided in a pendulum supported boating seat as disclosed in U.S. Pat. No. 4,425,863 to Cutler. While improving comfort for the user, the device does not enhance the stability of the craft. Other approaches for increasing stability are disclosed in U.S. Pat. No. 4,223,621 to Berger wherein pontoons are articulated to the main frame for facilitating righting after capsizing, U.S. Pat. No. 5,884,575 to Talasimov wherein a helmsman seat may be pivoted for balancing heeling of a sailboat, and U.S. Pat. No. 4,713,030 to Ingle wherein a spherical life rescue craft is provided with an independently rotating inner craft carrier.

In view of the foregoing, it would be desirable to provide a recreational watercraft that provides the occupants with anti-capsizing protection during hazardous water travel while increasing comfort and stability of the passengers during turbulent conditions.

SUMMARY OF THE INVENTION

The foregoing objects are accomplished by an anti-capsize watercraft in accordance with the invention that includes three radially and circumferentially spaced, rotatable floatation members or pontoons that ensure that at least two members are floating regardless of the rolling movement encountered. Additionally, the crew platform is pivotally supported about a longitudinal axis providing a self centered stable condition for the occupants under rough water conditions, thereby preventing capsizing. In the event the watercraft experiences capsizing conditions, the floatation members rotate to present a secondary floatation orientation with the crew platform maintaining a horizontally stable condition during the movement, thus increasing the safety and comfort of the crew.

Accordingly, it is an object of the present invention to provide a watercraft including plural floatation members that maintain craft stability under capsizing conditions.

Another object of the invention is to provide an anti-capsizing watercraft having plural floatation devices in contact with the water after extremes of craft rolling movement.

A further object of the invention is to provide a watercraft having pendulum supported crew area that maintains a stable position during travel in rough waters and including a rotating floatation assembly providing at least two floatation members under all conditions.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
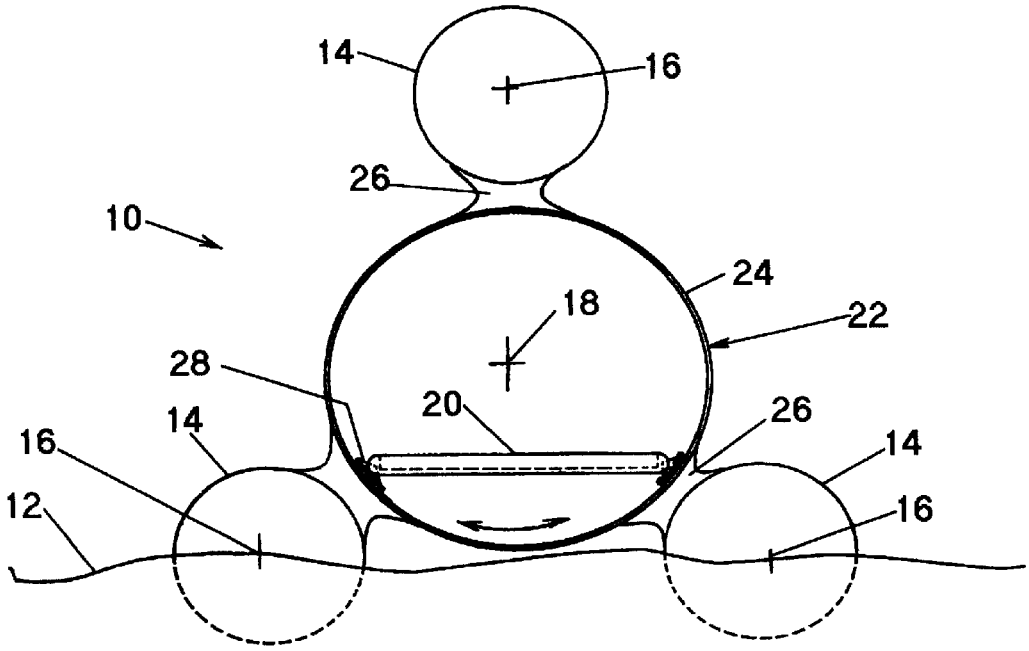
FIG. 1 is a front view of an anti-capsize watercraft in accordance with a preferred embodiment of the invention.
Figure 2:
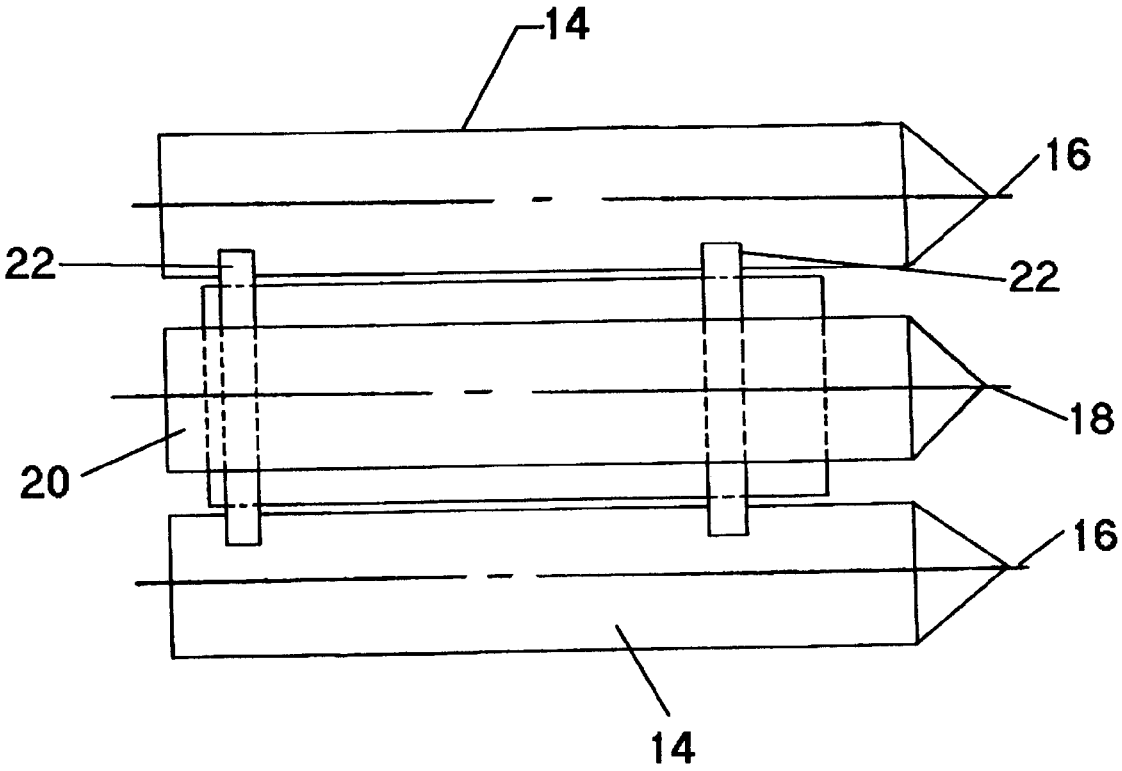
FIG. 2 is a top view of the watercraft shown FIG. 1.
Figure 3:
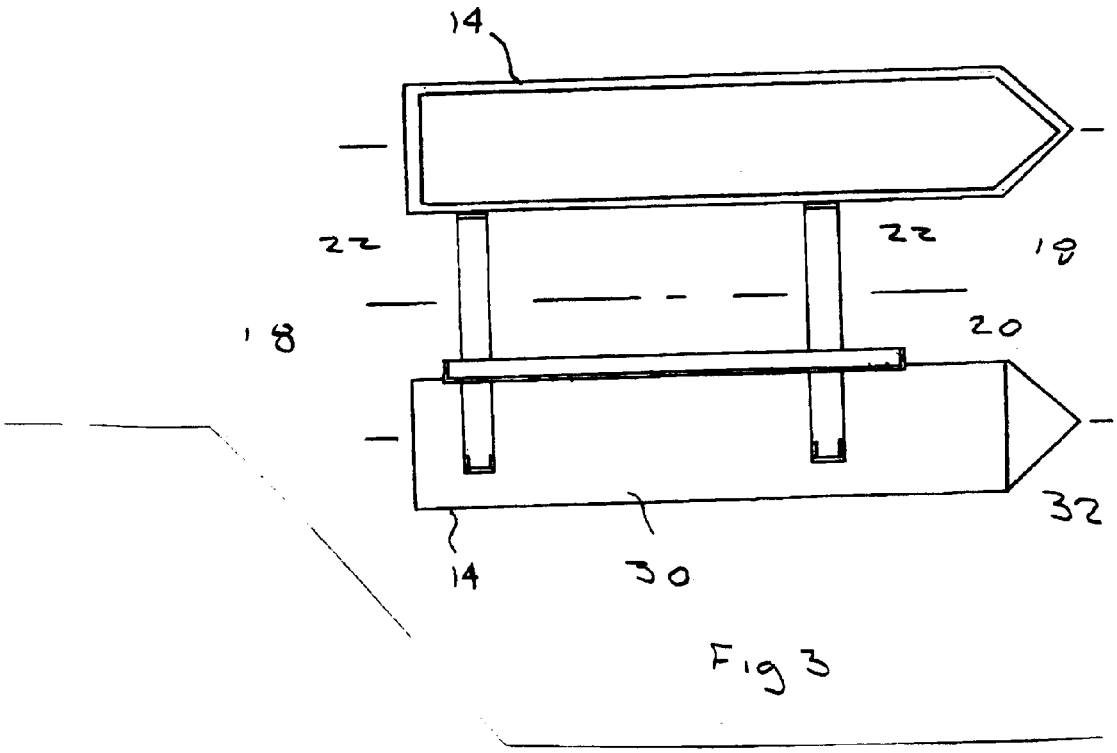
FIG. 3 is a side cross sectional view taken along line 3—3 in FIG. 2.
Figure 5:
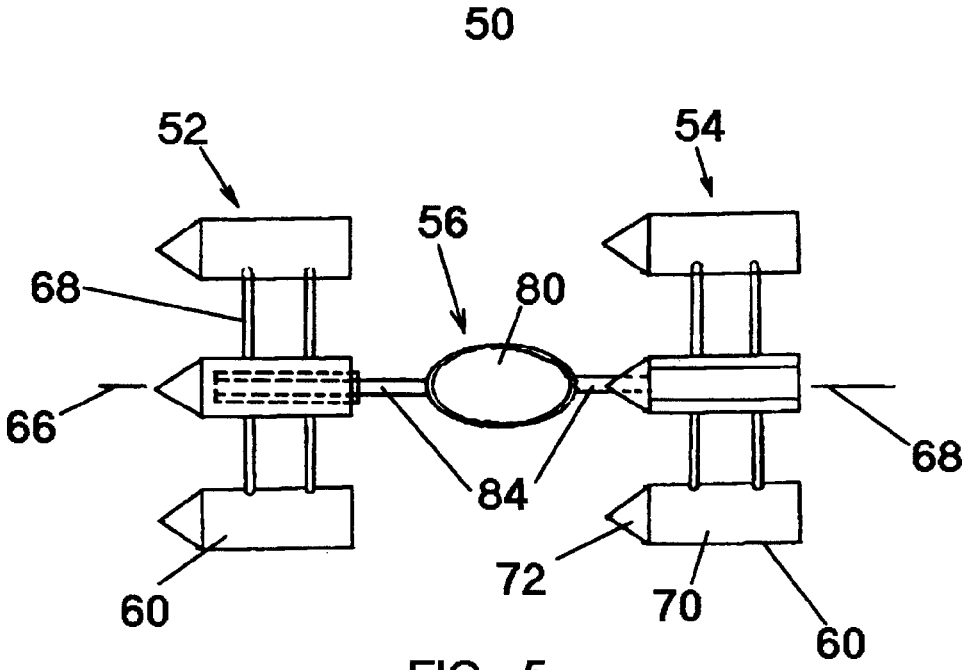
FIG. 5 is a top view of the watercraft shown in FIG. 4.
Figure 4:
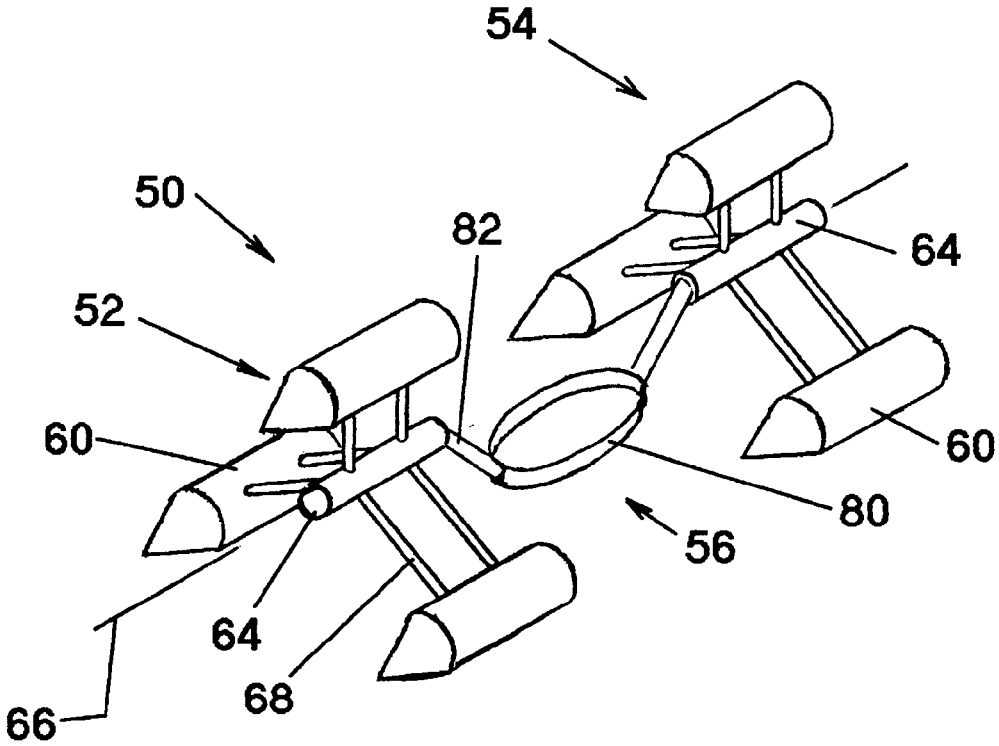
FIG. 4 is a perspective view of an anti-capsize watercraft in accordance with another embodiment of the invention.
Figure 6:
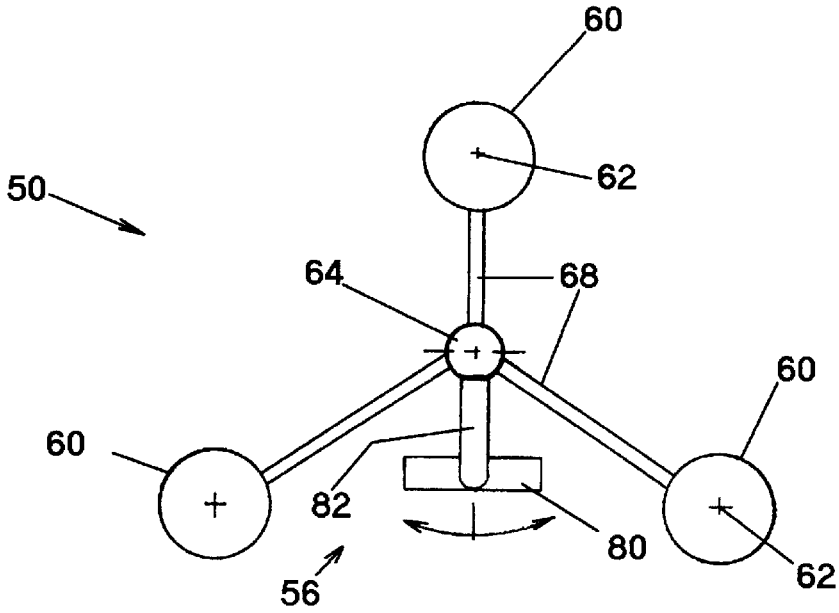
FIG. 6 is an enlarged front view of the watercraft shown in FIG. 4.
Figure 7:
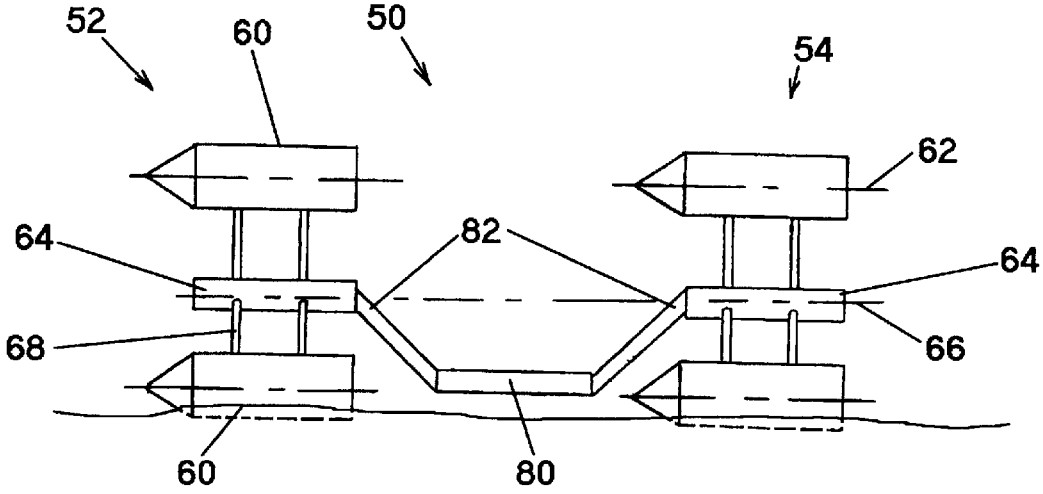
FIG. 7 is a side elevational view of the watercraft shown in FIG. 4.

Referring to the drawings for the purpose of describing one preferred embodiment and not for limiting same, FIG. 1 illustrates an anti-capsize watercraft 10 floating in stable position on a body of water 12. The watercraft 10 comprises three floatation modules 14 having parallel longitudinal axes 16 concentrically and equally radially spaced with regard to a watercraft axis 18, and a crew platform 20 supported for gravitational rotation about the watercraft axis 18 on hub members 22 in the form of cylindrical rings 24. The hub members 22 are structurally connected to the floatation modules 14 by radial strut members 26. The crew platform 20 is supported at lateral sides for rotation by bearing assemblies 28 about the inner cylindrical surfaces of the hub members 22.

Each floatation module 14 comprises a thin wall cylindrical body 30 terminating with a drag reducing frontal nose 32. As illustrated, the frontal nose 32 is conical, however, it will be appreciated that other drag reducing contours may be employed. The interior of the modules is sealed whereby each is buoyant.

The carrier member 22 is in the form of a cylindrical channel having an inwardly opening circumferential groove for supporting the bearing assemblies 30 to allow the crew platform to freely rotate and swing in response to movement of the individual floatation chambers during travel. The radial struts are in the form of radial plates mechanically with fasteners or by welding structurally connected between the floatation members and the hub members 22.

The crew platform 20 is a generally rectangular platform of sufficient size for carrying the watercraft occupants. The rear end of the crew platform 20 may be extended for the mounting of suitable marine propulsion.

In operation, the crew platform 20 will rotate, as a pendulum, to a stable, level position in response to movement of the floatation members during forward travel. In the event of rough water, sufficient to capsize a conventional craft, the floatation modules rotate about the watercraft axis 20 until the upper floatation member reaches the waterline for reestablishing floatation support with an adjacent module. During this assembly rotation, the crew platform 20 will rotate about the watercraft axis 18 thereby maintaining the crew in an operative position on the carrier, which automatically attains a stable position.

Referring to FIGS. 4 through 7, there is shown another embodiment of the anti-capsize watercraft 50. The watercraft 50 includes a forward floatation assembly 52, a rear flotation assembly 54 and a crew carrier 56 supported therebetween.

Each floatation assembly, and fore floatation assembly 52 for reference includes three floatation modules 60 having parallel longitudinal axes 62 and equally radially and circumferentially spaced with respect to a center cylindrical hub 64 coaxial with a watercraft axis 66 by radial struts 68. Each floatation module 60 includes a cylindrical body 70 and an antidrag conical nose. The floatation modules 60 are sealed and buoyant.

The crew carrier 56 includes a generally elliptical crew platform 80 rotatably supported by arm assemblies 82 at the hubs 64. Each arm assembly 82 includes an upwardly and outwardly inclined section terminating with a horizontal section telescopically received within the hub and rotatably supported by suitable anti-friction means, not shown, such as bearings or bushings. Thus in operation the crew carrier is gravitationally supported beneath the watercraft axis and free to rotate to a stable position in response to relative movement of the floatation modules in each floatation assembly. The independent floatation assemblies allow for differential relative movement while accommodating self-alignment of the crew carrier. The floatation assemblies, in response to rough water conditions, may jointly or independently rotate whereby the top floatation module becomes the active buoyant pontoon. During such transients, the crew carrier freely rotates about the hubs to maintain the operative position for the crew.

The present invention thus provides in each of the above-described embodiments an anti-capsizing watercraft design wherein the pendulum supported crew carrier seeks a stable condition in rough waters. Capsizing tendencies are overcome by the rotation of the floatation modules, which present a revised pairing of the modules in response to normal capsizing conditions.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. An anti-capsizing watercraft for propulsion over rough water, comprising: a float means for buoyantly supporting the watercraft on the water, said float means consisting of at least three flotation members radially and circumferentially spaced with respect to a watercraft axis; strut means connected at axially spaced locations to said floatation members by a pair of annular ring members concentric with said watercraft axis; and an occupant platform rotatably operatively connected at said annular ring members and vertically positioned between said water and said watercraft axis.

2. The watercraft as recited in claim 1 wherein said float means includes three equally circumferentially spaced flotation members.

3. The watercraft as recited in claim 2 including roller bearing means engaging an interior surface of each of said annular ring members.

4. The watercraft as recited in claim 2 wherein said floatation means comprises longitudinally spaced floatation assemblies consisting of three equally circumferentially spaced floatation members.

5. The watercraft as recited in claim 4 wherein said floatation members comprise a cylindrical body and a tapered frontal nose.

6. An anti-capsizing watercraft for propulsion over rough water, comprising: first and second floatation assemblies longitudinally spaced along a watercraft axis, each of said float assemblies comprising three elongated floatation members equally radially and circumferentially spaced and interconnected to a cylindrical hub located at said watercraft axis; a platform disposed between said float assemblies and below said watercraft axis and rotatably connected with said hub.

7. The watercraft as recited in claim 6 wherein said platform includes inner arms adjacent the platform extending upwardly and outwardly therefrom and terminating with horizontal arms telescopically received and pivotally supported by said hub.

* * * * *